US008816197B2

(12) United States Patent
Campbell et al.

(10) Patent No.: US 8,816,197 B2
(45) Date of Patent: Aug. 26, 2014

(54) PRESSURE BALANCED CONNECTOR TERMINATION

(71) Applicant: ITT Manufacturing Enterprises LLC, Wilmington, DE (US)

(72) Inventors: Charles O. Campbell, Santa Rosa, CA (US); Roger C. Williams, Santa Rosa, CA (US); Jeffrey Hamilton-Gahart, Santa Rosa, CA (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 0 days.

(21) Appl. No.: 14/054,137

(22) Filed: Oct. 15, 2013

(65) Prior Publication Data

US 2014/0097001 A1 Apr. 10, 2014

Related U.S. Application Data

(63) Continuation-in-part of application No. 13/644,782, filed on Oct. 4, 2012.

(51) Int. Cl.

| | |
|---|---|
| ***H01B 7/18*** | (2006.01) |
| ***H01R 13/523*** | (2006.01) |
| ***E21B 33/04*** | (2006.01) |
| ***H01R 13/52*** | (2006.01) |

(52) U.S. Cl.

CPC ..... *H01B 7/1805* (2013.01); *H01R 13/523* (2013.01); *E21B 33/04* (2013.01); *H01R 13/5205* (2013.01); *H01R 13/5216* (2013.01)

USPC ..... 174/23 R; 174/20; 174/77 R; 174/11 R; 439/272

(58) Field of Classification Search

USPC ..... 174/20, 23 R, 77 R, 11 R; 29/887; 439/272

See application file for complete search history.

(56) References Cited

U.S. PATENT DOCUMENTS

| | | | |
|---|---|---|---|
| 3,641,479 | A | 2/1972 | O'Brien |
| 3,729,699 | A | 4/1973 | Briggs |
| 4,080,025 | A | 3/1978 | Garnier |
| 4,105,279 | A | 8/1978 | Glotin |
| 4,142,770 | A | 3/1979 | Butler |
| 4,174,875 | A | 11/1979 | Wilson |

(Continued)

FOREIGN PATENT DOCUMENTS

| | | | |
|---|---|---|---|
| CN | 100431226 | C | 11/2008 |
| CN | 101976782 | A | 2/2011 |

(Continued)

OTHER PUBLICATIONS

International Search Report, dated Mar. 21, 2014, corresponding to counterpart International Patent Application No. PCT/US2013/062798.

*Primary Examiner* — Dhirubhai R Patel
(74) *Attorney, Agent, or Firm* — RatnerPrestia

(57) ABSTRACT

A pressure-balanced electrical cable assembly including a connector body, an electrical conductor positioned within the connector body, an interior chamber defined within the connector body, a dielectric fluid medium contained within the chamber, and a shuttle delimiting at least a portion of the chamber to prevent the escapement of the dielectric fluid from the chamber. The shuttle is moveable in response to differences between a pressure within the chamber and a pressure outside of the chamber.

21 Claims, 5 Drawing Sheets

(56) References Cited

U.S. PATENT DOCUMENTS

| | | | | |
|---|---|---|---|---|
| 4,390,229 | A | 6/1983 | Chevalier | |
| 4,488,765 | A | 12/1984 | Erbe | |
| 4,500,151 | A | 2/1985 | Ayers | |
| 4,500,156 | A | 2/1985 | Nguyen | |
| 4,515,426 | A | 5/1985 | Bager | |
| 4,561,679 | A | 12/1985 | Choate | |
| 4,589,717 | A | 5/1986 | Pottier | |
| 4,767,349 | A | 8/1988 | Pottier | |
| 4,780,574 | A | 10/1988 | Neuroth | |
| 4,797,117 | A | 1/1989 | Ayers | |
| 4,859,196 | A | 8/1989 | Durando | |
| 4,880,390 | A | 11/1989 | Brackmann | |
| 4,948,377 | A | 8/1990 | Cairns | |
| 5,334,032 | A | 8/1994 | Myers | |
| 5,645,442 | A | 7/1997 | Cairns | |
| 5,760,334 | A | 6/1998 | Ziemek | |
| 5,899,765 | A | 5/1999 | Niekrasz | |
| 6,200,152 | B1 | 3/2001 | Hopper | |
| 6,780,037 | B1 | 8/2004 | Parmeter | |
| 6,796,821 | B2 | 9/2004 | Cairns | |
| 6,832,924 | B2 | 12/2004 | Maletzki | |
| 6,916,193 | B2 | 7/2005 | Varreng | |
| 6,932,636 | B2 | 8/2005 | Abbey | |
| 7,112,080 | B2 | 9/2006 | Nicholson | |
| 7,367,848 | B2 | 5/2008 | John | |
| 7,533,461 | B2 | 5/2009 | Griffiths | |
| 7,695,301 | B2 | 4/2010 | Mudge | |
| 7,737,361 | B2 * | 6/2010 | Huspeni et al. | 174/74 R |
| 7,767,908 | B2 * | 8/2010 | Sylvan | 174/74 R |
| 7,806,708 | B2 | 10/2010 | Erstad | |
| 7,955,105 | B2 | 6/2011 | Maeland | |
| 7,959,454 | B2 | 6/2011 | Ramasubramanian | |
| 8,025,506 | B2 | 9/2011 | Cairns | |
| 2007/0040459 | A1 | 2/2007 | Oh | |
| 2007/0169954 | A1 | 7/2007 | Bertini et al. | |
| 2011/0306225 | A1 | 12/2011 | Chaize | |
| 2012/0100738 | A1 | 4/2012 | Palinkas et al. | |
| 2013/0312996 | A1 | 11/2013 | Nicholson | |
| 2014/0099812 | A1 | 4/2014 | Burrow et al. | |

FOREIGN PATENT DOCUMENTS

| | | |
|---|---|---|
| EP | 0637675 | 2/1995 |
| EP | 0902505 A2 | 3/1999 |
| EP | 2386714 A2 | 11/2011 |

* cited by examiner

PRESSURE BALANCED CONNECTOR TERMINATION

CROSS-REFERENCE TO RELATED APPLICATION

This patent application is a continuation-in-part patent application of U.S. patent application Ser. No. 13/644,782, filed Oct. 4, 2012, the contents of which are incorporated by reference herein in their entirety.

FIELD OF THE INVENTION

This invention generally relates to a pressure-balanced electrical connector having a chamber filled with dielectric fluid.

BACKGROUND OF THE INVENTION

In providing electrical power to different types of wells, the connector systems will be exposed to rapidly varying pressures, temperatures and deleterious gases, each of which can cause internal sealing arrangements in a power cable or a power connector to fail.

Power cables, which may be used for electric submersible pumps (ESP) in oil wells, are typically constructed with a copper conductor, an insulator that surrounds the copper conductor, and a lead sheath that surrounds the insulator. Lead-sheathed power cables are known and disclosed in, for example, U.S. Pat. No. 4,780,574 to Neuroth and U.S. Pat. No. 5,760,334 to Ziemek, each of which are incorporated by reference herein in their entirety.

The lead material of the lead sheath protects the insulator of the power cable from damage resulting from the deleterious gases of the harsh oil well environment. The lead material of the lead sheath may also protect rubber sealing elements that are used to terminate these power cables. The rubber sealing elements are particularly vulnerable to explosive decompression and other types of damage caused by the gases.

Lead is commonly used because it is substantially impermeable to gas and moisture, inexpensive, flexible, ductile and easily removable. However, many of these qualities also make the lead sheath susceptible to damage upon changes in pressure and temperature if attempts are made to rigidly attach the lead sheath to a metal shell of a connector.

The invention described herein maintains the gas permeation protection provided by the lead material while offering a robust solution that can better withstand mechanical handling as well as changes in pressure and temperature.

SUMMARY OF THE INVENTION

The above-described gas permeation protection is provided by a pressure balanced chamber of dielectric fluid, such as grease, oil or silicone, surrounding the connector termination.

According to one aspect of the invention, a pressure-balanced electrical cable assembly includes a connector body, an electrical conductor positioned within the connector body, an interior chamber defined within the connector body, a dielectric fluid medium contained within the chamber, and a shuttle delimiting at least a portion of the chamber to prevent the escapement of the dielectric fluid from the chamber. The shuttle is moveable in response to differences between a pressure within the chamber and a pressure outside of the chamber.

According to another aspect of the invention, the pressure-balanced electrical cable assembly includes a holder defining a wall of the chamber. The holder includes a first opening through which an electrical conductor is positioned, and a second opening in which the moveable shuttle is positioned.

According to yet another aspect of the invention, the holder includes at least three openings, and a first shuttle is positioned in a first opening of the at least three openings of the holder, a second shuttle is positioned in a second opening of the at least three openings of the holder, and an electrical conductor is positioned within a third opening of the at least three openings of the holder.

These and other aspects of the present invention will become clear from the detailed discussion below when taken into consideration with the drawings. It is to be understood that the following discussion is intended merely to illustrate the preferred embodiment of the present invention. However, the present invention is not limited to the illustrated embodiment, but is limited solely by the claims appended to this specification.

BRIEF DESCRIPTION OF THE FIGURES

The invention is best understood from the following detailed description when read in connection with the accompanying drawing. It is emphasized that, according to common practice, the various features of the drawing are not to scale. Included in the drawing are the following figures.

DETAILED DESCRIPTION OF THE INVENTION

The invention will next be illustrated with reference to the figures. Such figures are intended to be illustrative rather than limiting and are included herewith to facilitate explanation of the present invention. In the figures, like item numbers refer to like elements throughout. Also, in the figures, many of the components of the power cable assembly are shown in cross-section and have a cylindrical shape.

As used herein, the term 'proximal' refers to a position that is near a connection point 11, 111, 211 or 311, and the term 'distal' refers to a position that is distant from the connection point 11, 111, 211 or 311.

Figure 1A:
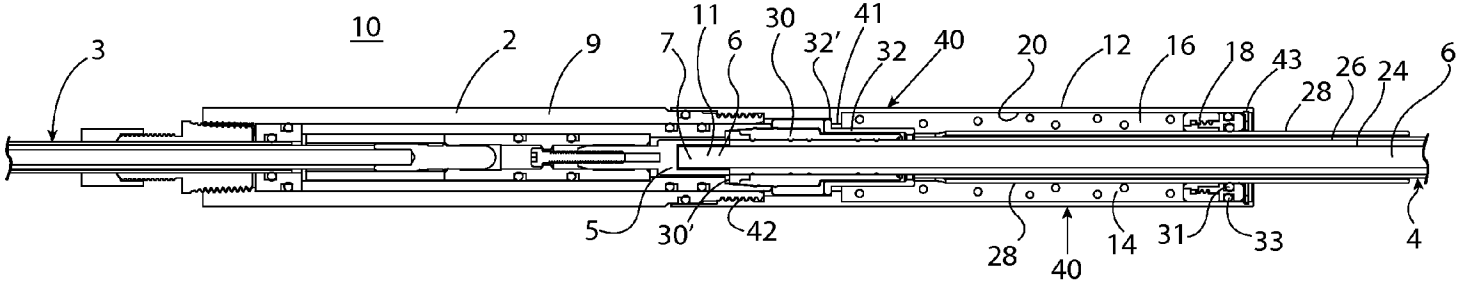
FIG. 1A depicts a cross-sectional view of a power cable assembly, according to a first exemplary embodiment of the invention.
Figure 1B:
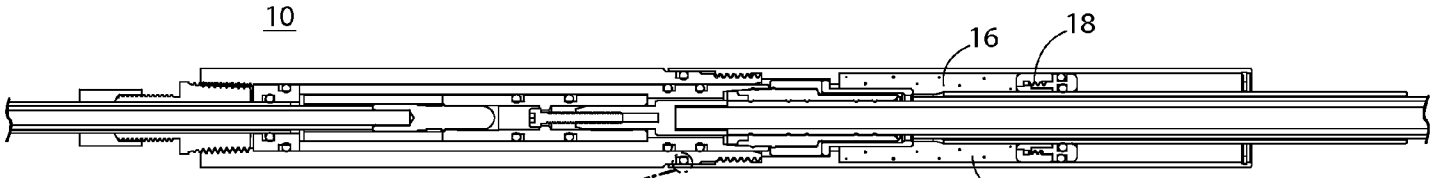
FIG. 1B depicts the power cable assembly of FIG. 1A exposed to external pressure.

FIGS. 1A and 1B depict a cross-sectional view of a power cable assembly 10 according to one exemplary embodiment of the invention. In FIG. 1B, the power cable assembly 10 of FIG. 1A is shown exposed to external fluid pressure. The power cable assembly 10 generally includes a power cable sub-assembly 2 that is configured to be connected to a power cable 4 by a sleeve assembly 40.

is The power cable sub-assembly 2 comprises several interconnected components including a power cable 3 that is electrically and mechanically connected to a socket 5, and an outer sleeve 9 that surrounds the socket 5 and the terminal end of the power cable 3. The power cable sub-assembly 2 is configured to be connected to the power cable 4. More particularly, the socket 5 of the power cable sub-assembly 2 is configured to receive the terminal end 7 of the copper conductor 6 of the power cable 4. Power and/or signals can be transferred between the power cable sub-assembly 2 and the power cable 4 at a power connection point 11 that is defined at the intersection of the socket 5 and the terminal end 7 of the copper conductor 6.

The power cable 4 includes the copper conductor 6, an EPDM insulative shield 24 that surrounds the copper conductor 6, and a lead barrier 26 that is molded over the EPDM insulative shield 24. The lead barrier 26 protects the EPDM insulative shield 24 from exposure to harmful gasses and liquids that surround the power cable 10 in use. The lead barrier 26 is an optional component of the power cable 4 and may be omitted.

The power cable 4 also includes a stainless steel tube 28 that surrounds the lead barrier 26, a rubber boot seal 30 that is positioned over the ends of the EPDM insulative shield 24 and the lead barrier 26, and a compression ring 32 that is positioned over the boot seal 30. The tube 28, the rubber boot seal 30 and the compression ring 32 may or may not be considered as forming part of the power cable 4. Alternatively, those components may be considered as separable parts that form part of either the sleeve assembly 40 or part of the cable assembly 10.

The tube 28 provides a smooth surface upon which a shuttle 18 can translate, as will be described in greater detail later. The interior surface of the tube 28 may be adhered to the outer surface of the lead barrier 26 by a metal filled epoxy. One end of the tube 28 is positioned within a chamber 14 and is spaced apart from the boot seal 30. The opposite end of the tube 28 extends outside of the chamber 14.

The rubber boot seal 30, which is susceptible to damage upon contact with deleterious gases emanating outside of the chamber 14, is protected by dielectric fluid that is contained within the chamber 14. The boot seal 30 may be adhered to the exterior surface of either one or both of the insulative shield 24 and the lead barrier 26 by a metal filled epoxy.

The boot seal 30 is positioned on the power cable 4 such that its proximal end face 30' is positioned flush with the proximal end face of the insulative shield 24. The boot seal 30 also includes an exterior shoulder upon which a flange 32' of the compression ring 32 is seated. The flange 32' of the compression ring 32 is sandwiched between the boot seal 30 and a flange 41 of the outer sleeve 12.

Referring now to the features of the sleeve assembly 40, the sleeve assembly 40 is configured to releasably connect the power cable sub-assembly 2 to the power cable 4. For that reason, the sleeve assembly 40 may also be referred to herein as a 'connector.' The sleeve assembly 40 also prevents the boot seal 30 from exposure to harmful gases and liquids that surround the power cable 10 in use.

The sleeve assembly 40 generally includes a tubular-shaped outer sleeve 12, which is optionally composed of stainless steel, and a tubular-shaped shuttle 18, which is optionally composed of an elastomeric material, such as rubber. The outer surface of the shuttle 18 is sealingly positioned against an inner surface 20 of the outer sleeve 12, and the inner surface of the shuttle 18 is sealingly positioned against an outer surface of the tube 28. A flange 43 is disposed at the distal end of the interior surface of the outer sleeve 12 to prevent detachment of the shuttle 18 from the outer sleeve 12. The shuttle 18 includes a hole through which the stainless steel tube 28 of the power cable 4 passes.

An annular chamber 14 is defined between the interior surface 20 of the outer sleeve 12 and at least a portion of the exterior surfaces of the tube 28, the boot seal 30 and the lead barrier 26. The annular chamber 14 is filled with dielectric silicone grease or other dielectric fluid, as depicted by bubbles, by an operator. One or more surfaces of the boot seal 30, lead barrier 26, compression ring 32, insulative shield 24, shuttle 18 are at least partially immersed in the dielectric fluid. The dielectric fluid prevents the ingress of harmful liquids and gases into the chamber 14.

The chamber 14 is delimited by the shuttle 18. In operation, as shown in FIG. 1B, the shuttle 18 moves leftward when it is exposed to external pressure as any air pockets or compressible elements within the dielectric fluid will contract in volume (note difference in bubble size between FIGS. 1A and 1B). The shuttle 18 may return to its initial position once the external pressure subsides. This is referred to as a "pressure balanced" chamber.

At the proximal end of the sleeve assembly 40, the boot seal 30 and the compression ring 32 prevent escapement of the grease from the chamber 14. At the distal end of the sleeve assembly 40, the O-ring shuttle 18 seals against the surfaces of the sleeve 12 and the tube 28 to prevent escapement of the grease from the chamber 14.

The shuttle 18 includes a hole through which the stainless steel tube 28 of the power cable 4 passes. The outer surface of the shuttle 18 is positioned against the inner surface 20 of the outer sleeve 12. An elastomeric O-ring 31 is mounted in a channel that is formed on the interior surface of the shuttle 18. The O-ring 31 is positioned to bear on the exterior surface of the tube 28 to prevent the escapement of fluid at the interface between the interior surface of the shuttle 18 and the exterior surface of the tube 28. Another elastomeric O-ring 33 is mounted in a channel that is formed on the exterior surface of the shuttle 18. The O-ring 33 is positioned to bear on the interior surface of the outer sleeve 12 to prevent the escapement of fluid at the interface between the exterior surface of the shuttle 18 and the interior surface of the outer sleeve 12. Alternatively, the O-rings 31 and 33 may be replaced by C-rings that are formed of a metallic material.

Mechanical threads 42 are provided on the interior surface of the proximal end of the outer sleeve 12 for connecting the sleeve assembly 40 with mating threads on the power cable sub-assembly 2. Specifically, the mechanical threads 42 are configured for releasably engaging mating threads on the exterior surface of the mating sleeve 9 of the power cable sub-assembly 2. Item 42 may represent any connection means, such as a fastener, pin, slot, plug, socket, retainer, lock, adhesive, bolt, nut, engaging surface, engageable surface, magnet, or joint, for example.

Figure 2:
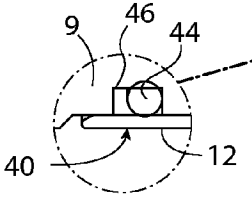
FIG. 2 depicts a detailed view of the power cable assembly of FIG. 1B showing a connection between components of the power cable assembly.

FIG. 2 depicts an O-ring 44 that is positioned at the interface between the terminal end of the outer sleeve 12 and a channel 46 that is defined at the proximal end of the mating sleeve 9 of the power cable sub-assembly 2. The O-ring 44 prevents the escapement of fluid at the interface between the sleeves 9 and 12. The O-ring 44 may be replaced by a metallic C-ring, if so desired.

Referring back to FIGS. 1A, 1B and 2, and according to one exemplary method of assembling the power cable assembly 10, the shuttle 18 is positioned inside the outer sleeve 12. The tube 28 is mounted to the power cable 4. The tube 28 and the power cable 4 are then positioned through the hole in the seal 18. The rubber boot seal 30 and the compression ring 32 are mounted to the power cable 4. Before mating the sleeves 9 and 12 together, a pre-determined amount of dielectric fluid is distributed into the chamber 14. The threads 42 of the outer sleeve 12 of the sleeve assembly 40 are then engaged with the mating threads of the mating sleeve 9 of the power cable sub-assembly 2. Upon engaging those mechanical threads, a shoulder 41 of the outer sleeve 12 bears against the distal end of the compression ring 32, which bears against the boot seal 30, thereby compressing the proximal end face of the boot seal 30 against the proximal end face of the socket 5 of the power cable sub-assembly 2.

At the same time, the terminal end 7 of the copper conductor 6 of the power cable 4 seats in the recess of the socket 5 of the power cable sub-assembly 2, thereby creating a power connection between the power cable sub-assembly 2 and the power cable 4. Also, at the same time, the proximal ends of both the boot seal 30 and the insulative shield 24 bear against (but are disconnected from) the terminal end of the socket 5 of the power cable sub-assembly 2. The power cable assembly 10 is ready for use, and the power cable assembly 10 may be immersed in an oil well, or other environment.

The sleeve assembly 40 may be sold and distributed along with the power cable 4. That assembly may be supplied with or without a supply of dielectric fluid.

The sleeve assembly 40 may also be sold and distributed as a kit for retrofitting an existing power cable assembly. The kit would include, at a minimum, the outer sleeve 12 and the shuttle 18. The kit may also include the tube 28, the rubber boot seal 30, the compression ring 32 and/or a supply of dielectric fluid.

It should be understood that the materials recited herein may vary, the methods by which components are formed may vary, and the ways by which the components are connected together may vary.

Figure 3A:
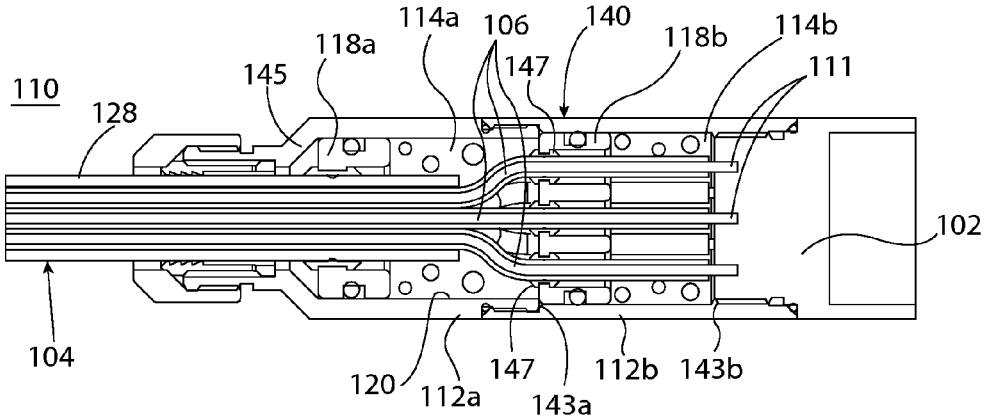
FIG. 3A depicts a cross-sectional view of another power cable assembly, according to a second exemplary embodiment of the invention.
Figure 3B:
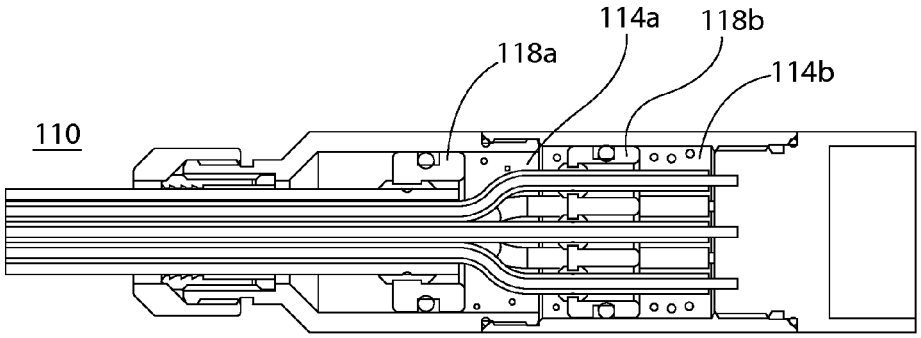
FIG. 3B depicts the power cable assembly of FIG. 3A exposed to external pressure.

FIG. 3A depicts a cross-sectional view of another power cable assembly 110 having multiple conductors 106, according to another exemplary embodiment of the invention. FIG. 3B depicts the power cable assembly 110 of FIG. 3A exposed to external pressure. Many of the details of the power cable assembly 10 also apply to the power cable assembly 110, and only the differences between those power cable assemblies will be described hereinafter.

The power cable assembly 110 generally includes a power cable sub-assembly 104 that is configured to be connected to an insulator 102 (or a mating power cable) by a sleeve assembly. 140. The power cable 104 includes a plurality of discrete conductors 106 (three shown). The power cable 104 also includes a tube 128 that surrounds the conductors 106.

The tube 128 provides a smooth surface upon which a first shuttle 118*a* can translate, as will be described in greater detail later. The interior surface of the tube 128 may be adhered to the conductors 106 by a metal filled epoxy, for example. One end of the tube 128 is positioned within a chamber 114*a*, and the opposite end of the tube 128 extends outside of the chamber 114*a*.

Referring now to the features of the sleeve assembly 140, the sleeve assembly 140 is configured to releasably connect the power cable 104 to the insulator 102. For that reason, the sleeve assembly 140 may also be referred to herein as a 'connector.' The sleeve assembly 140 also shields the conductors 106 from exposure to harmful gases and liquids that surround the power cable assembly 110 in use.

The sleeve assembly 140 generally includes a two-piece tubular-shaped outer sleeve 112*a* and 112*b* (referred to collectively as outer sleeve 112), each of which is optionally composed of stainless steel, and two tubular-shaped shuttles 118*a* and 118*b*, which are optionally composed of an elastomeric material such as rubber. The shuttles 118*a* and 118*b* are positioned against an inner surface 120 of the outer sleeve 112. Angled surface 145 of the outer sleeve 112*a* prevents detachment of the shuttle 118*a* from the outer sleeve 112. Stops 143*a* and 143*b* are disposed along the outer sleeve 112*b* to prevent detachment of the shuttle 118*b* from the outer sleeve 112.

Unlike the sleeve assembly 40, the sleeve assembly 140 includes two fluid filled chambers 114*a* and 114*b* (referred to collectively as chambers 114) and two shuttles 118*a* and 118*b* (referred to collectively as shuttles 118) for the purpose of redundancy.

The shuttle 118*a* includes a hole through which the tube 128 of the power cable 104 passes. The shuttle 118*a* slides along the surface of the tube 128 in response to pressures emanating external to the power cable assembly 110, as evidenced by comparing FIGS. 3A and 3B.

The other shuttle 118*b* includes several holes, and a grommet 147 that is fixedly positioned in each hole. The number of holes and grommets corresponds to the number of conductors 106. Each conductor 106 of the cable 104 passes through an opening in one of the grommets 147, as shown. The grommets 147 of the shuttle 118*b* slide along the surface of the individual conductors 106 in response to pressures emanating external to the power cable assembly 110, as evidenced by comparing FIGS. 3A and 3B. Thus, the grommets 147 translate along with the shuttle 118*b* in response to external pressure.

One chamber 114*a* is defined between the shuttles 118*a* and 118*b*, and the other chamber 114*b* is defined between the shuttle 118*b* and the insulator 102. The annular chambers 114*a* and 114*b* are each filled with dielectric silicone grease or other dielectric fluid, as depicted by bubbles. The conductors 106 are at least partially immersed in the dielectric fluid. The dielectric fluid prevents the ingress of harmful liquids and gases into the chambers 114*a* and 114*b*.

In operation, as shown in FIGS. 3B, the shuttles 118*a* and 118*b* move rightward when the shuttle 118*a* is exposed to external pressure as any air pockets or compressible elements within the dielectric fluid will contract in volume (note to difference in bubble size between FIGS. 3A and 3B). The shuttles 118*a* and 118*b* may return to their initial positions in FIG. 3A once the external pressure subsides. This is referred to as a "pressure balanced" chamber.

As noted above, two shuttles 118 and two chambers 114 are provided for the purpose of redundancy. In the event that the first shuttle 118*a* fails, thereby resulting in contamination of the chamber 114*a*, a second failure would have to occur for the contamination to reach the other chamber 114*b*.

As an alternative to the embodiment shown in FIGS. 3A and 3B, the grommets 147 are fixed to the conductors 106 such that grommets 147 and the shuttle 118*b* can not translate over the conductors 106; and a moveable seal (not shown) is positioned over the seal 118*b*. The moveable seal would translate over the seal 118*b* in response to external pressure.

Figure 4A:
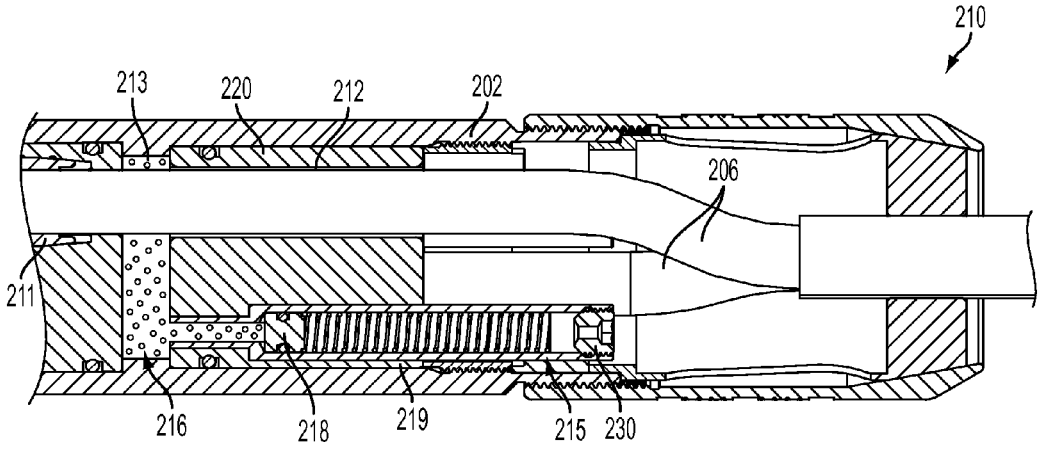
FIG. 4A depicts a cross-sectional view of another power cable assembly, according to a third exemplary embodiment of the invention.

FIG. 4A depicts a cross-sectional view of a power cable assembly 210 having multiple conductors 206 (three, for example), according to still another exemplary embodiment of the invention. Many of the details of the power cable assembly 10 also apply to the power cable assembly 210, and the primary differences between those power cable assemblies will be described hereinafter.

The cable assembly 210 includes a connector body 202 defining an interior space 213. The connector body 202 may also be referred to herein as a sleeve, conduit, tube or shell. A pressure balanced chamber 216 (referred to hereinafter as chamber 216) is defined within the interior space 213. The chamber 216 has a substantial cylindrical shape, and also partially extends within the proximal end of the shuttle tube assemblies 215, as best shown in FIG. 4A. The chamber 216 is defined at a location between the connection point 211 and the shuttle tube and cable holder 220. The proximal face 220*a* of the shuttle tube and cable holder 220 forms the distal boundary wall of the chamber 216. The chamber 216 is filled with a dielectric fluid medium, for example. The dielectric fluid medium may be gas impermeable. Air bubbles are depicted in the chamber 216 in FIG. 4A.

It should be understood that the boundaries of the chamber 216 do not necessarily have to be defined by the outermost cylinder (i.e., body 202) of the power cable assembly 210. The chamber 216 could be defined by a component of the cable assembly 210 that is positioned interior of the connector body 202.

Figure 4B:
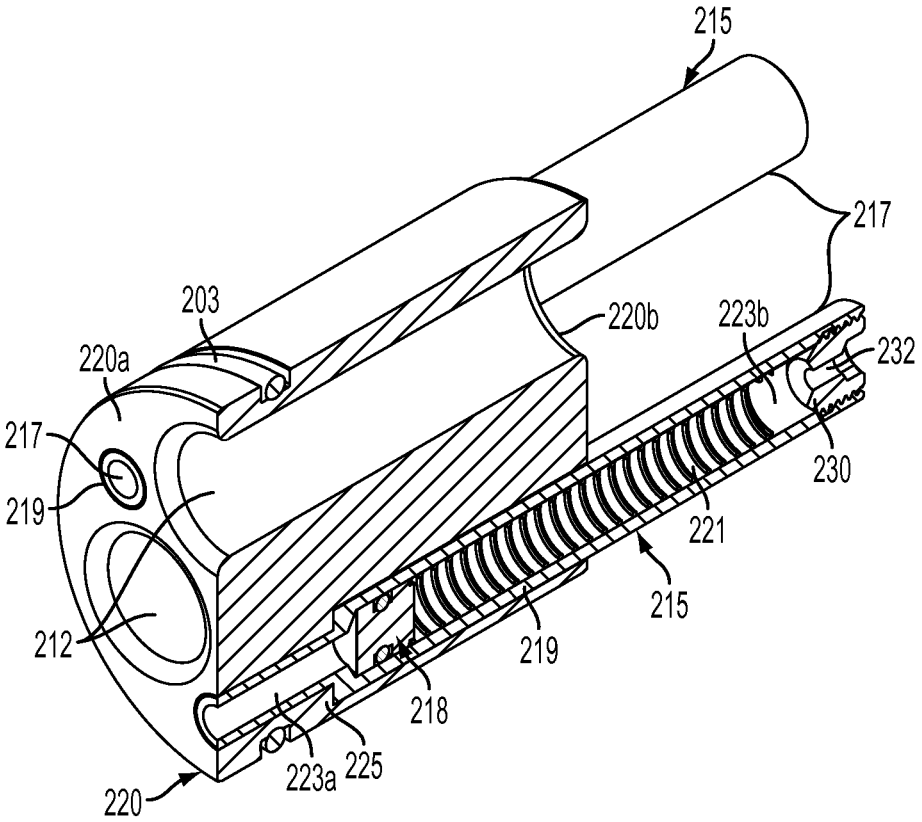
FIG. 4B depicts a shuttle tube and cable holder of the power cable assembly of FIG. 4A.

FIG. 4B depicts the shuttle tube and cable holder 220 (referred to hereinafter as holder 220) of the power cable assembly 210. The holder 220 of the power cable assembly 210 is positioned within the interior space of the connector body 202. The holder 220 comprises a cylindrical body having a proximal face 220*a*, a distal face 220*b*, and a revolved outer surface extending between the faces. A series of openings 212 (three, for example) are defined through the body of the holder 220 to accommodate respective conductors 206. The openings 212 are spaced in a radial direction from the longitudinal axis of the holder 220 and are spaced in a circumferential direction about the holder 220 (e.g., by 120 degrees). The spacing may be even in the radial and circumferential directions. The cable assembly 210 may include any number of conductors 206 and corresponding openings 212.

A single electrical conductor 206 is positioned in each opening 212. Although not shown, an O-ring may be positioned on the circumference of each conductor 206 to prevent the passage of fluid at the interface between the exterior revolved surface of the conductor 206 and the interior revolved surface of the opening 212 through which the conductor 206 is positioned.

A series of counter-bored openings 219 (three, for example) are defined through the body of the holder 220 to accommodate respective shuttle tube assemblies 215. The openings 219 are spaced in a radial direction from the longitudinal axis of the holder 220, and are spaced in a circumferential direction about the holder 220 (e.g., by 120 degrees). The spacing may be even in the radial and circumferential directions.

The openings 219 are separate from and disconnected from the openings 212. The openings 212 and 219 are alternately positioned in a circumferential direction about the holder 220, such that each opening 219 is positioned between adjacent openings 212, and vice versa.

An O-ring 203 is positioned on the circumference of the holder 220 to prevent the passage of fluid at the interface between the exterior revolved surface of the holder 220 and the interior revolved surface of the connector body 202.

Turning now to the features of the shuttle tube assemblies 215, each shuttle tube assembly 215 generally includes a tube 217 mounted within an opening 219 defined in the holder 220, a moveable shuttle 218 positioned within the interior of the tube 217 that is biased by a spring 221, and a plug 232 that is fixedly mounted to the distal end of the tube 217.

The hollow tube 217 of each shuttle tube assembly 215 is fixedly mounted within the opening 219 of the holder 220. The distal end of the hollow tube 217 protrudes from the distal end 220*b* of the holder 220. The hollow tube 217 includes a shoulder 225 that bears on an interior shoulder of the opening 219 of the holder 220. The shoulder 225 marks the separation between the proximal interior region 223*a* and the distal interior region 223*b* of the tube 217. The proximal interior region 223*a* forms part of the chamber 216 that contains the dielectric medium.

The movable shuttle 218 of each shuttle tube assembly 215 comprises a cylindrical shaped solid body. The shuttle 218 is positioned within the distal interior region 223*b* of the hollow tube 217. An O-ring is positioned on the circumference of the movable shuttle 218 to prevent the passage of fluid at the interface between the exterior revolved surface of the shuttle 218 and the interior revolved surface of the tube 217. A spring 221 biases the shuttle 218 toward the chamber 216. The shuttle 218 is capable of translating within the distal interior region 223*b* of the hollow tube 217 between the shoulder 225 and the plug 230.

The plug 230 of each shuttle tube assembly 215 is fixedly mounted to the distal end of the tube 217. A passage 232 is defined through the plug 230 to permit the passage of fluid within the tube 217, such that the distal end face of the shuttle 218 is exposed to fluids or gasses within either the well environment or atmosphere, for example.

The proximal end face of the shuttle 218 is exposed to the dielectric medium that is contained within the portion of the chamber 216 that extends into the proximal interior region 223*a* of the tube 217. The proximal end face of the shuttle 218 at least partially delimits, i.e., forms the boundary of, the chamber 216. Thus, the proximal end face of the shuttle 218 is exposed to the dielectric medium, whereas the distal end face of the shuttle 218 is not exposed to the dielectric medium. The distal end face of the shuttle 218 may be exposed to either the well environment or atmosphere, for example.

In operation, when the dielectric medium within the pressure balanced chamber 216 expands or contracts due to temperature and/or pressure, the shuttle 218 translates within the tube 217 in response to differences between a pressure within the chamber 216 and a pressure within the distal interior region 223*b* of the tube 217. Translation of the shuttle 218 is limited between the shoulder 225 and the plug 218. The dielectric medium provides a dielectric barrier, which may be gas impermeable, that shields elastomers (not shown) that are located proximal of the chamber 216 and creates the dielectric isolation of the connector system.

Unlike the shuttle 18 of the power cable assembly 10, the shuttles 218 of the power cable assembly 210 are not moveably positioned over the conductors 206, or any other component, of the cable assembly 210. Separating the shuttles 218 from the other components of the cable assembly 210 eliminates the possibility that the shuttle 218 could bind on another component.

Figure 5:
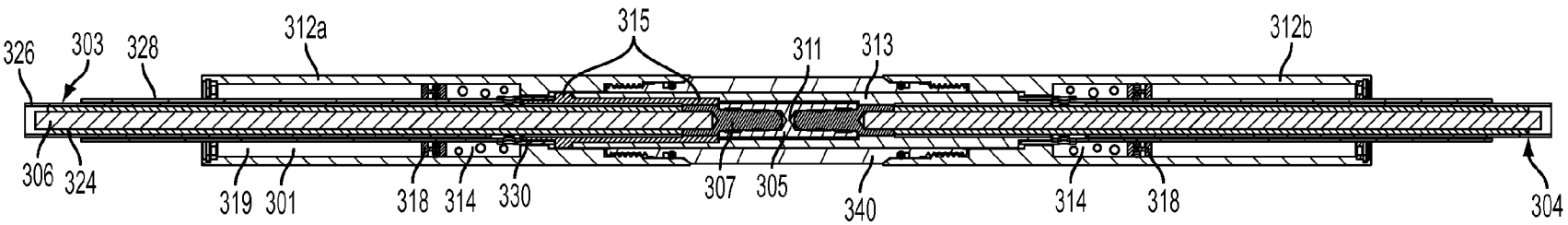
FIG. 5 depicts a cross-sectional view of another power cable assembly, according to a fourth exemplary embodiment of the invention.

FIG. 5 depicts a cross-sectional view of a power cable assembly 310, according to still another exemplary embodiment of the invention. Many of the details of the power cable assembly 10 apply to the power cable assembly 310, and the primary differences between those power cable assemblies will be described hereinafter.

The power cable assembly 310 has a substantially symmetrical design and generally includes a single-conductor power cable 303 that is connected to another single-conductor power cable 304 by a double-ended socket 305. The double-ended socket 305 transfers power and/or signals between the power cables 303 and 304 at the power connection point 311.

Each power cable 303 and 304 includes a copper conductor 306, a pin 307 that is fixedly mounted to the proximal end of the conductor 306, an insulative shield. 324 that surrounds the copper conductor 306, and a lead barrier 326 that is positioned over the insulative shield 324. The lead barrier 326 protects the insulative shield 324 from exposure to harmful gasses and liquids that surround the power cable 310 in use. The lead barrier 326 is an optional component of the power cables 303 and 304 and may be omitted.

The power cable assembly 310 also includes a tube 328 that surrounds each lead barrier 326. The tube 328 may be composed of stainless steel, for example. An attached flange 330 is positioned over the proximal end of each tube 328. The attached flange 330 is also sandwiched between a distal end of a sleeve 315 and a internal shoulder formed on a connector shell 312*a*. The tubes 328 and the attached flange 330 may or may not be considered as forming part of the respective power cables 303 and 304. Alternatively, those components may be considered as separable parts that form part of the power cable assembly 310.

The double-ended socket 305 is positioned within a dielectric insulative sleeve 313. The dielectric insulative sleeve 313 has a hollow cylindrical body. One end of the dielectric insulative sleeve 313 is captivated by the flange 330 of the power cable 304, and the opposite end of the sleeve 313 partially surrounds and overlaps another dielectric insulative sleeve 315. The sleeve 315 also has a hollow cylindrical body. The sleeve 315 is captivated by the attached flange 330 of the power cable 303. The dielectric insulative sleeves 313 and 315 may be composed of any dielectric insulative material.

The dielectric insulative sleeve 313 is positioned within a male to male connector 340. The connector 340 has a hollow cylindrical body including male threads that are defined at opposite ends thereof. The connector shell 312*a* that is associated with the power cable 303 includes female threads at its proximal end that are threadedly connected to one threaded end of the connector 340. Similarly, the connector shell 312*b* associated with the power cable 304 includes female threads at its proximal end that are threadedly connected to the opposite threaded end of the connector 340.

The power cable assembly 310 includes two pressure balanced chambers 314 that are each delimited by a moveable shuttle 318. Although only the chamber 314 and the shuttle 318 that are associated with the power cable 303 will be described hereinafter, it should be understood that the chamber 314 and the shuttle 318 that are associated with the power cable 304 are structurally and functionally equivalent to their counterparts associated with the power cable 303.

Referring now to the pressure balanced chamber 314 associated with the power cable 303, an annular space 301 is formed between the revolved surfaces of the connector shell 312*a* and the tube 328. A tubular-shaped shuttle 318 is positioned within the annular space 301, and is sealingly compressed between an inner surface of the connector shell 312*a* and outer surface of the tube 328. The tube 328 provides a smooth surface upon which the shuttle 318 can translate.

The shuttle 318 divides the annular space 301 between the pressure balanced chamber 314 and an annular space 319. The chamber 314 is filled with a dielectric fluid medium, which is depicted by bubbles in FIG. 5. No fluid is contained within the annular space 319. The shuttle 318 prevents the passage of fluid between the space 319 and the chamber 314.

In operation, the shuttle 318 associated with the power cable 303 moves rightward when it is exposed to external pressure as any air pockets or compressible elements within the dielectric fluid will contract in volume. The power cable assembly 310 is shown exposed to external pressure in FIG. 5. The shuttle 318 associated with the power cable 303 may return to its initial position once the external pressure subsides. It should be understood that the other shuttle 318 moves leftward when it is exposed to external pressure, and moves rightward to return to its initial position once the external pressure subsides. The dual pressure balanced chamber design provides redundancy if one of the shuttles 318 were to fail or become bound in place. The remaining shuttle 318 and pressure balanced chamber 314 would assume the pressure balancing functionality of the power cable assembly 310.

The pressure balanced chambers 314 respond to rapid decompression and pressure impulses caused by the activation and deactivation of an electrical submersible pump to which the power cable assembly 310 may be connected.

Testing has shown that the dielectric fluid chambers 314 either limit or prevent well fluid that has penetrated the lead barrier 326 (or other lead barrier outside of the cable assembly 310) from penetrating the power connection point 311 (or another critical point) and causing a high voltage short to ground.

Testing has also shown that the power cable assembly 310 is particularly suitable for well temperatures above 500 degrees Fahrenheit. Because such high temperatures rapidly degrade elastomeric materials, the power cable assembly 310 employs a minimal amount of elastomers as compared with the other cable embodiments that are described herein.

Although the invention is illustrated and described herein with reference to specific embodiments, the invention is not intended to be limited to the details shown. Rather, various modifications may be made in the details within the scope and range of equivalents of the claims and without departing from the spirit of the invention. For example, if the cables 4 and 104 are sufficiently smooth and cylindrical, and the shuttles 18 and 118*a* are sufficiently compliant, the tubes 28 and 128, respectively, may be omitted without sacrificing operational performance. The invention described herein is not limited to electrical power cables for oil wells. The details of the invention may be applied to any type of termination, wire, cable or cord that is used for any application.

What is claimed:

1. A pressure-balanced electrical cable assembly comprising:

a connector body;

an electrical conductor positioned within the connector body;

an interior chamber defined within the connector body;

a dielectric fluid medium contained within the interior chamber;

a holder positioned within the connector body; and a shuttle positioned in an opening of the holder and delimiting at least a portion of the chamber to prevent the escapement of the dielectric fluid medium from the chamber, the shuttle being moveable in response to differences between a pressure within the chamber and a pressure outside of the chamber.

2. The pressure-balanced electrical cable assembly of claim 1, wherein the holder at least partially defining a boundary of the chamber, wherein the holder includes a second opening through which the electrical conductor is positioned.

3. The pressure-balanced electrical cable assembly of claim 1 further comprising a spring for biasing the shuttle towards the chamber.

4. The pressure-balanced electrical cable assembly of claim 1 further comprising a plug that serves as a translation stop for the shuttle.

5. The pressure-balanced electrical cable assembly of claim 4, wherein the plug includes an opening that exposes the shuttle to the pressure outside of the chamber.

6. The pressure-balanced electrical cable assembly of claim 1 further comprising a plurality of shuttles.

7. The pressure-balanced electrical cable assembly of claim 6, wherein the plurality of shuttles are spaced in a circumferential direction about the connector.

8. The pressure-balanced electrical cable assembly of claim 1 further comprising a plurality of electrical conductors positioned within the connector body.

9. The pressure-balanced electrical cable assembly of claim 8 further comprising a plurality of shuttles, wherein the shuttles and the electrical conductors are alternately positioned in a circumferential direction about the cable assembly.

10. The pressure-balanced electrical cable assembly of claim 1, wherein the electrical conductor is immersed in the fluid medium.

11. The pressure-balanced electrical cable assembly of claim 1 further comprising:

a second connector body;

a second electrical conductor positioned within the second connector body, said second electrical conductor being electrically connected to said electrical conductor;

a second interior chamber defined within the second connector body and dielectric fluid medium contained within the second interior chamber; and a second holder positioned within the second connector body; and a second shuttle positioned in an opening of the second holder and delimiting at least a portion of the second chamber to prevent the escapement of dielectric fluid medium from the second chamber, the second shuttle being moveable in response to differences between a pressure within the second chamber and a pressure outside of the second chamber.

12. A pressure-balanced electrical cable assembly comprising:

a connector body;

an interior chamber that is defined within the connector body;

a dielectric fluid medium contained within the interior chamber; and a holder that at least partially defines a boundary surface of the chamber, wherein the holder includes a first opening through which an electrical conductor is positioned and a second opening in which a moveable shuttle is positioned, wherein the shuttle is moveable in response to differences between a pressure within the interior chamber and a pressure outside of the interior chamber.

13. The pressure-balanced electrical cable assembly of claim 12, wherein the first opening and the second opening are separate and disconnected.

14. The pressure-balanced electrical cable assembly of claim 12, wherein the holder includes a third opening in which another electrical conductor is positioned.

15. The pressure-balanced electrical cable assembly of claim 14, wherein the holder includes a fourth opening in which another shuttle is positioned.

16. The pressure-balanced electrical cable assembly of claim 15, wherein the shuttles and the conductors are alternately positioned in a circumferential direction about the cable assembly.

17. A pressure-balanced electrical cable assembly comprising:

a connector body;

an interior chamber that is defined within the connector body;

a dielectric fluid medium contained within the interior chamber;

a holder that at least partially defines a boundary surface of the chamber and comprises at least three openings defined therethrough;

a first shuttle positioned in a first opening of the at least three openings of the holder, the first shuttle being moveable in response to differences between a pressure within the chamber and a pressure outside of the chamber;

a second shuttle positioned in a second opening of the at least three openings of the holder, the second shuttle being moveable in response to differences between a pressure within the chamber and a pressure outside of the chamber; and an electrical conductor positioned within the third opening of the at least three openings of the holder.

18. The pressure-balanced electrical cable assembly of claim 17 further comprising another electrical conductor positioned within a fourth opening of the holder.

19. The pressure-balanced electrical cable assembly of claim 18, wherein the shuttles and the conductors are alternately positioned in a circumferential direction about the cable assembly.

20. The pressure-balanced electrical cable assembly of claim 17, wherein the electrical conductor is immersed in the dielectric fluid medium.

21. The pressure-balanced electrical cable assembly of claim 17, wherein one surface of each shuttle is immersed in the dielectric fluid medium and another surface of each shuttle is not immersed in the dielectric fluid medium.

* * * * *